US006374795B2

(12) United States Patent
Furuya et al.

(10) Patent No.: US 6,374,795 B2
(45) Date of Patent: Apr. 23, 2002

(54) ENGINE

(75) Inventors: Ketaro Furuya; Hiroki Tawa; Koji Yasuda, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/746,073

(22) Filed: Dec. 26, 2000

(30) Foreign Application Priority Data

Jan. 17, 2000 (JP) ..... 2000-010369

(51) Int. Cl.[7] ..... F02F 7/00
(52) U.S. Cl. ..... 123/195 R; 123/195 C
(58) Field of Search ..... 123/195 C, 195 R

(56) References Cited

FOREIGN PATENT DOCUMENTS

JP 61-23851 * 2/1986

JP 3-49996 10/1991

* cited by examiner

*Primary Examiner*—Noah P. Kamen
(74) *Attorney, Agent, or Firm*—Arent Fox Kintner Plotkin & Kahn, PLLC

(57) ABSTRACT

An engine includes an engine block having a crankcase, which has a first bearing on one sidewall and an opening on the other sidewall to assemble a crankshaft. A case cover is coupled to the crankcase by a plurality of bolts to close the opening, and which has a second bearing. Two knock pins are fit into the crankcase and the case cover over their joint faces at locations closer to a cylinder bore in the engine block than the second bearing. The knock pins define the position for coupling the crankcase and the case cover to each other and contribute to an increase in rigidity of the case cover. The supporting strength for the crankshaft is increased and the weight of the case cover is reduced.

6 Claims, 6 Drawing Sheets

4

ENGINE

BACKGROUND OF THE INVENTION

1. Field of the Invention

The present invention relates to an engine. Particularly, an improvement of an engine including a crankshaft having first and second journals disposed at opposite ends of the crankshaft. An engine block has a crankcase with a first bearing to support the first journal on one sidewall and an opening is provided in the other sidewall to facilitate assembly of the crankshaft. A case cover is coupled to the crankcase by a plurality of bolts to close the opening.

2. Description of the Related Art

Such an engine is known, as disclosed, for example, in Japanese Utility Model Publication No.3-49996.

In order to define a position for coupling the crankcase and the case cover to each other in the engine, it is conventional practice to fit knock pins into at least two positioning bores which open into joint faces of the crankcase and the case cover. The two knock pins are disposed on opposite sides of the axis of the crankshaft. The knock pins are used exclusively to define the position for coupling the crankcase and the case cover to each other.

SUMMARY OF THE INVENTION

Accordingly, it is an object of the present invention to provide an engine which is constructed with a durability in such a manner that at least two knock pins fit into the crankcase and the case cover over their joint faces not only define the position for coupling of the crankcase and the case cover to each other, as in the conventional engine described above, but also increase the rigidity of the case cover.

To achieve the above object, according to a first aspect and feature of the present invention, there is provided an engine including a crankshaft having first and second journals disposed at opposite ends thereof. An engine block has a crankcase with a first bearing that supports the first journal on one sidewall and an opening is provided in the other sidewall to facilitate assembly of the crankshaft. A case cover is coupled to the crankcase by a plurality of bolts to close the opening. A second bearing is also provided to support the second journal, wherein at least two knock pins are fitted into the crankcase and the case cover over their joint faces at locations closer to a cylinder bore in the engine block than the second bearing.

The first and second bearings correspond to first and second bearing bushes in an embodiment of the present invention, which will be described hereinafter. With the above arrangement, when an explosion load is applied from the crankshaft to the case cover during an explosion stroke of the engine, a tensile stress is generated on the case cover over a wide area between the second bearing and the two knock pins. At this point, the case cover, which has a strong resistance to the tensile stress, can exhibit a high rigidity. Therefore, the two knock pins define the position for coupling the crankcase and the case cover to each other, and moreover increase the rigidity of the case cover. Thus, it is possible to increase the supporting strength for the crankshaft while reducing the weight of the case cover.

According to a second aspect and feature of the present invention, in addition to the first feature, the two knock pins are substantially equidistantly positioned on opposite sides of a plane that includes an axis of a cylinder bore and an axis of the crankshaft.

With the above arrangement, it is possible to equalize the shearing load applied to each knock pin and disperse the tensile stress in the case cover, thereby enhancing the durability of the knock pins and the case cover.

According to a third aspect and feature of the present invention, in addition to the first or second features, one of the knock pins is hollow. An oil passage in the engine block and an oil passage in the case cover communicate with each other through a hole in the hollow knock pin.

With the above arrangement, one of the hollow knock pins has a function of permitting communication between the oil passage in the engine block and the oil passage in the case cover. Therefore, the oil passages and the knock pin can be disposed coaxially, and thus, the disposition of the oil passage and the knock pin in the narrow joint faces can be achieved easily.

According to a fourth aspect and feature of the present invention, in addition to any of the first to third features, the knock pins are press-fit into one of the crankcase and the case cover.

With the above arrangement, a fitting gap for the knock pins is provided only between each knock pin and the other of the crankcase and the case cover. Therefore, it is possible to limit dislocation between the joint faces of the crankcase and the case cover due to the relatively small fitting gap, which enhances the coupling accuracy.

The above and other objects, features and advantages of the invention will become apparent from the following description taken in conjunction with the accompanying drawings.

DESCRIPTION OF THE PREFERRED EMBODIMENT

Figure 1:
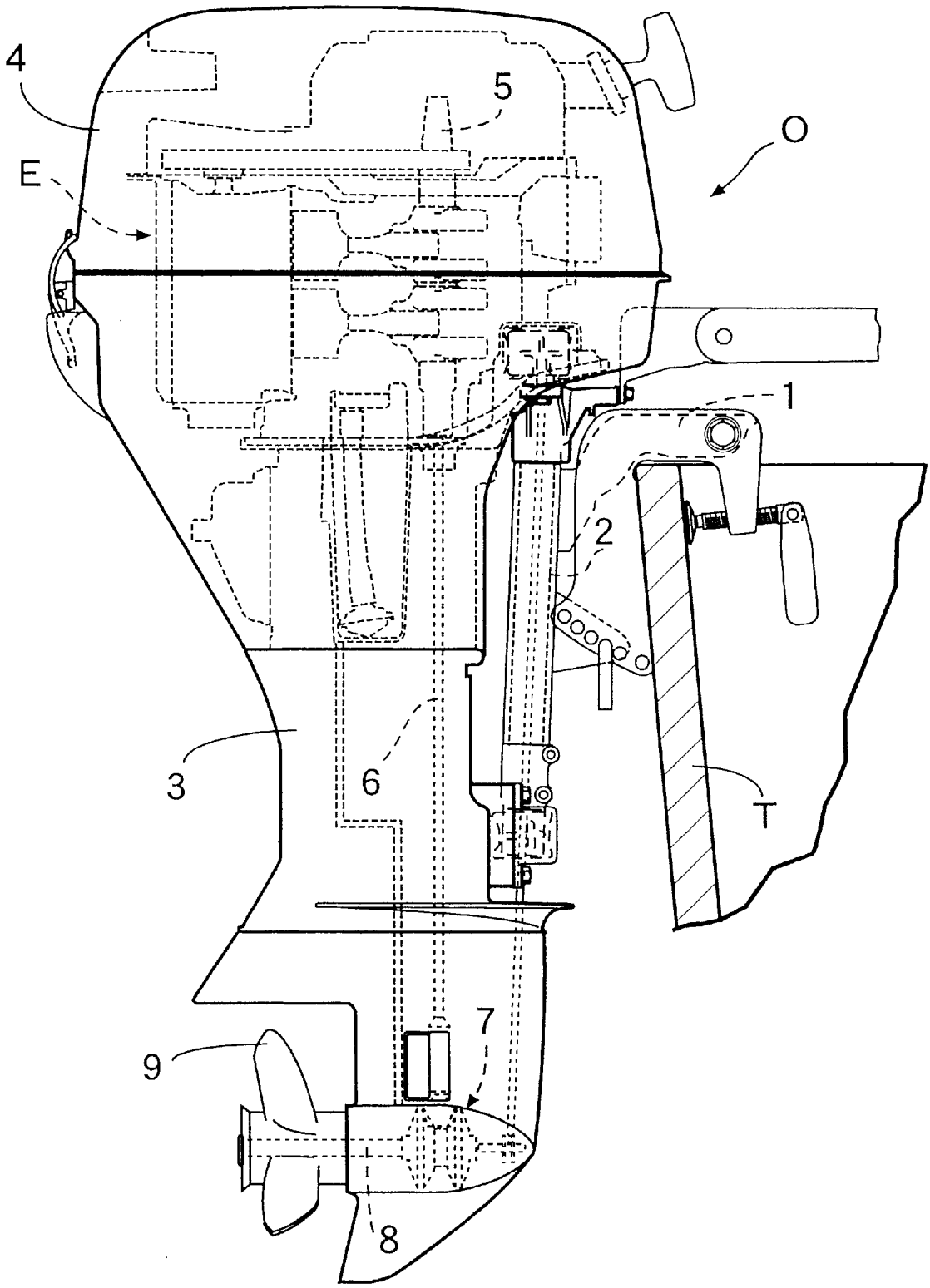
FIG. 1 is a side view of an outboard engine system including an engine according to the present invention.

Referring to FIG. 1, an outboard engine system O includes a stern bracket 1 clamped at a transom T of a hull. A vertically extending casing 3 that swings in a lateral direction relative to the hull is connected to the stern bracket 1 through a swivel shaft 2. An engine E is mounted at an upper portion of the casing 3 and an engine cover 4 is coupled to the casing 3 to cover the engine E. Power output from a crankshaft 5 of the engine E is transmitted to a propeller shaft 8 supported at a lower portion of the casing 3 through a drive shaft 6 disposed in the casing 3 and a bevel gear transmitting device 7 capable of switching-over the forward and rearward movements from each other, thereby driving a propeller 9 mounted at a rear end of the propeller shaft 8.

Figure 2:
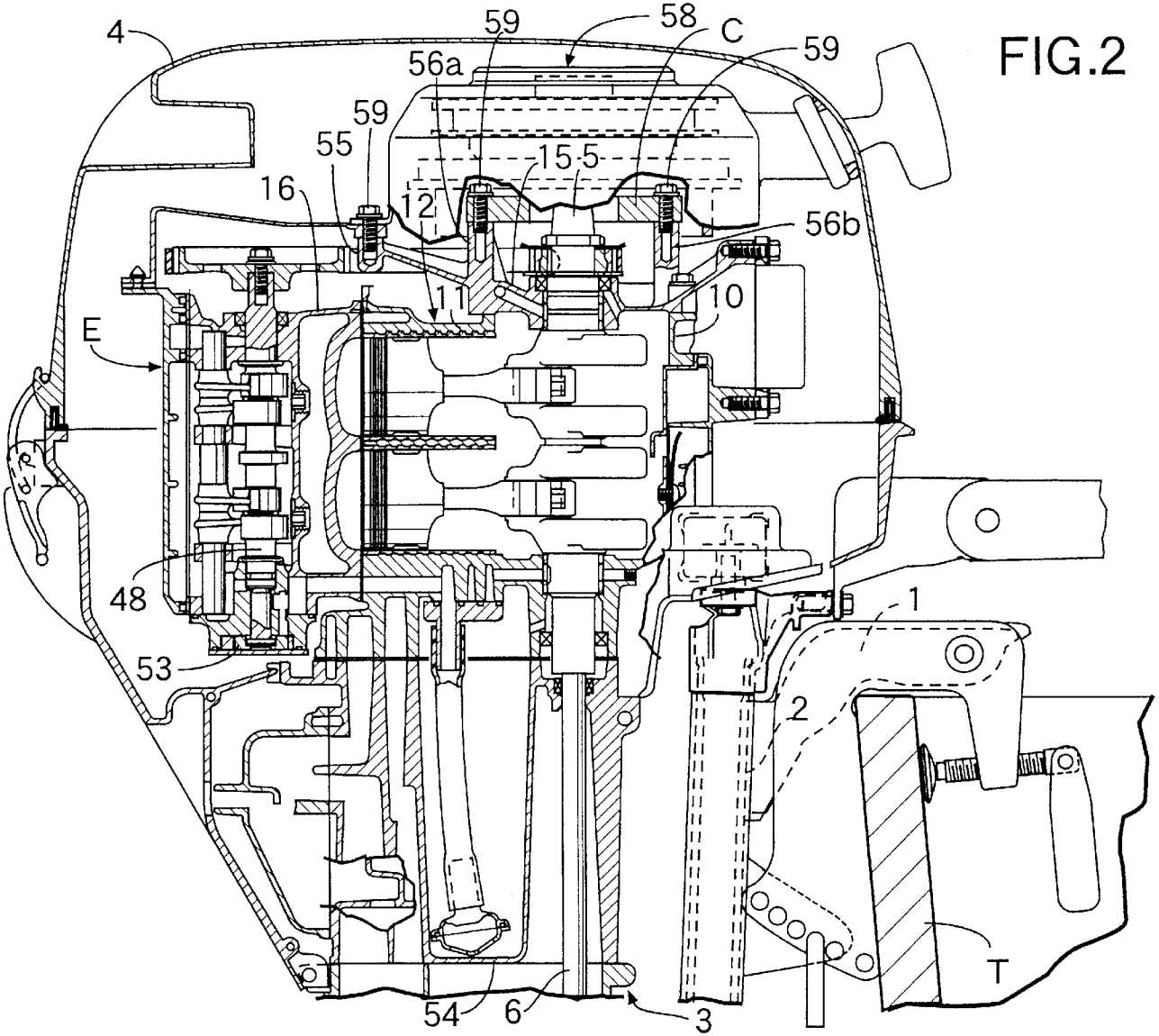
FIG. 2 is a cross-sectional view of the engine mounted in the engine casing.
Figure 3:
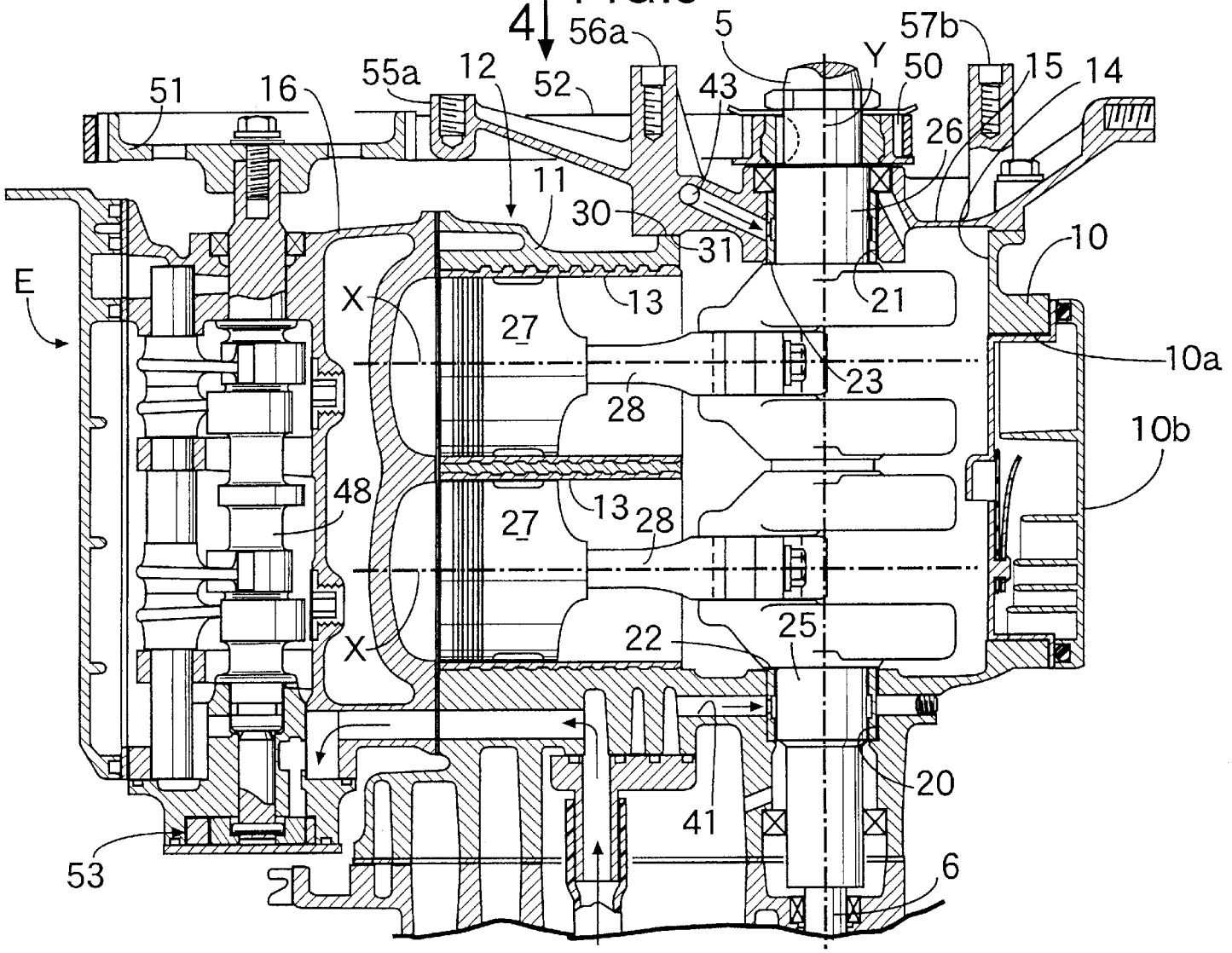
FIG. 3 is an enlarged view of the engine illustrated in FIG. 2.

Referring to FIGS. 2 and 3, the engine E is mounted in the casing 3 in an attitude in which the crankshaft 5 has been turned vertically and a cylinder block 11 has been turned rearwards of the hull. The engine E includes an engine block 12 with a crankcase 10 and the cylinder block 11 formed integrally with each other. Two upper and lower cylinder bores 13, 13 having axes turned horizontally are provided in the cylinder block 11.

The crankcase 10 has a closed bottom wall and an upper wall provided having an opening 14 for assembling the crankshaft 5. A case cover 15 is coupled to the crankcase 10 to cover the opening 14. Its coupling structure will be described below.

First and second bearing bores 20 and 21 are provided in the bottom wall of the crankcase 10 and the case cover 15. A lower first journal 25 and an upper second journal 26 of the crankshaft 5 are carried by first and second bearing bushes 22 and 23 which are fitted in the bearing bores 20 and 21, respectively. Pistons 27, 27 reciprocally movable in the cylinder bores 13, 13 are connected to the crankshaft 5 through connecting rods 28, 28, respectively.

Each connecting rod 28, 28 has a larger end of a split structure, and a working bore 10*a* is provided in a sidewall of the crankcase 10 opposite to the cylinder bores 13, 13 for assembling the connecting rods 28, 28. The working bore 10*a* is closed by a side lid 10*b*.

The structure of coupling the crankcase 10 and the case cover 15 will be described with reference to FIGS. 4 to 6.

The crankcase 10 and the case cover 15 are each provided with a pair of positioning bores 32 and 33; 34 and 35, respectively, which open into a joint face 30, 31 thereof. The positioning bores 32, 33, 34 and 35 are disposed at locations closer to the cylinder block 11 than the second bearing bush 23 and spaced equidistantly on opposite sides of a plane P including an axis Y of the crankshaft 5 and axes X of the cylinder bores 13, 13. Halves of a pair of knock pins 36 and 37 are press-fit into the positioning bores 32 and 33 in the crankcase 10, and the positioning bores 34 and 35 in the case cover 15 are fit over the other halves of the knock pins 36 and 37, respectively. Thus, the joint positions of the crankcase 10 and the case cover 15 are defined to coaxially arrange the first and second bearing bushes 22 and 23.

A plurality of threaded bores 38 are provided in the crankcase 10 and open into the joint face 30 to surround the opening 14. A corresponding number of bolt-insertion bores 39 are provided in the case cover 15. Thus, the crankcase 10 and the case cover 15 are coupled to each other by threadedly fitting bolts 40 through the bolt-insertion bores 39 into the threaded bores 38 and then tightening the bolts 40. A liquid packing is then applied to at least one of the joint faces 30 and 31 of the crankcase 10 and the case cover 15.

One of the knock pins 36 is hollow such that a hole 36*a* in the hollow knock pin 36 is connected at one end thereof to an oil passage 42 defined in the cylinder block 11 and at the other end to an oil passage 43 defined in the case cover 15. Therefore, both of the oil passages 42 and 43 communicate with each other through the hole 36*a* in the knock pin 36. The oil passage 42 in the cylinder block 11 communicates with a lubrication bore (not shown) in the first bearing bush 22, while the oil passage 43 in the case cover 15 communicates with a lubrication bore (not shown) in the second bearing bush 23.

Figure 4:
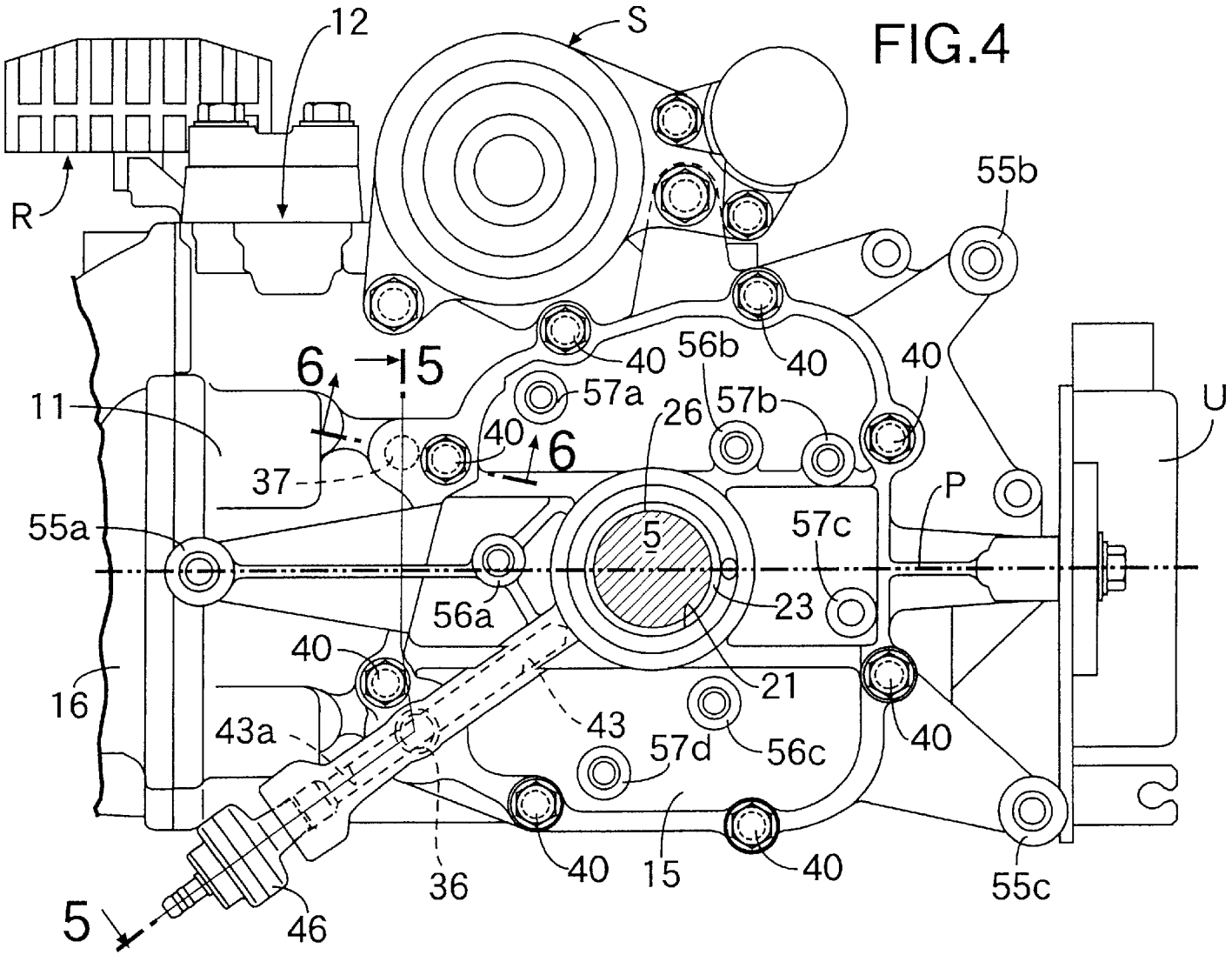
FIG. 4 is a top view of the engine illustrated in FIG. 3 as taken in the direction of an arrow 4.
Figure 5:
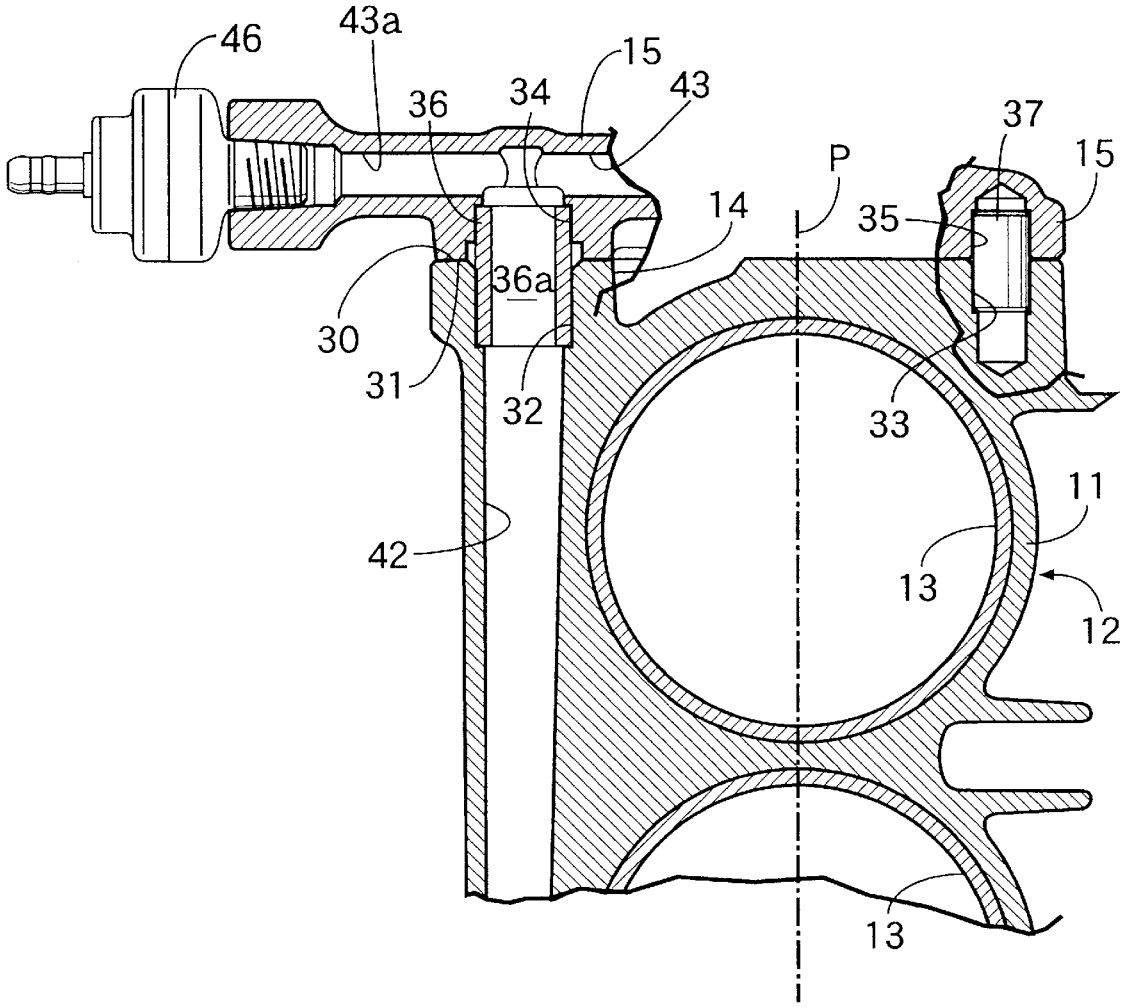
FIG. 5 is a cross-sectional view taken along section line 5—5 in FIG. 4.
Figure 6:
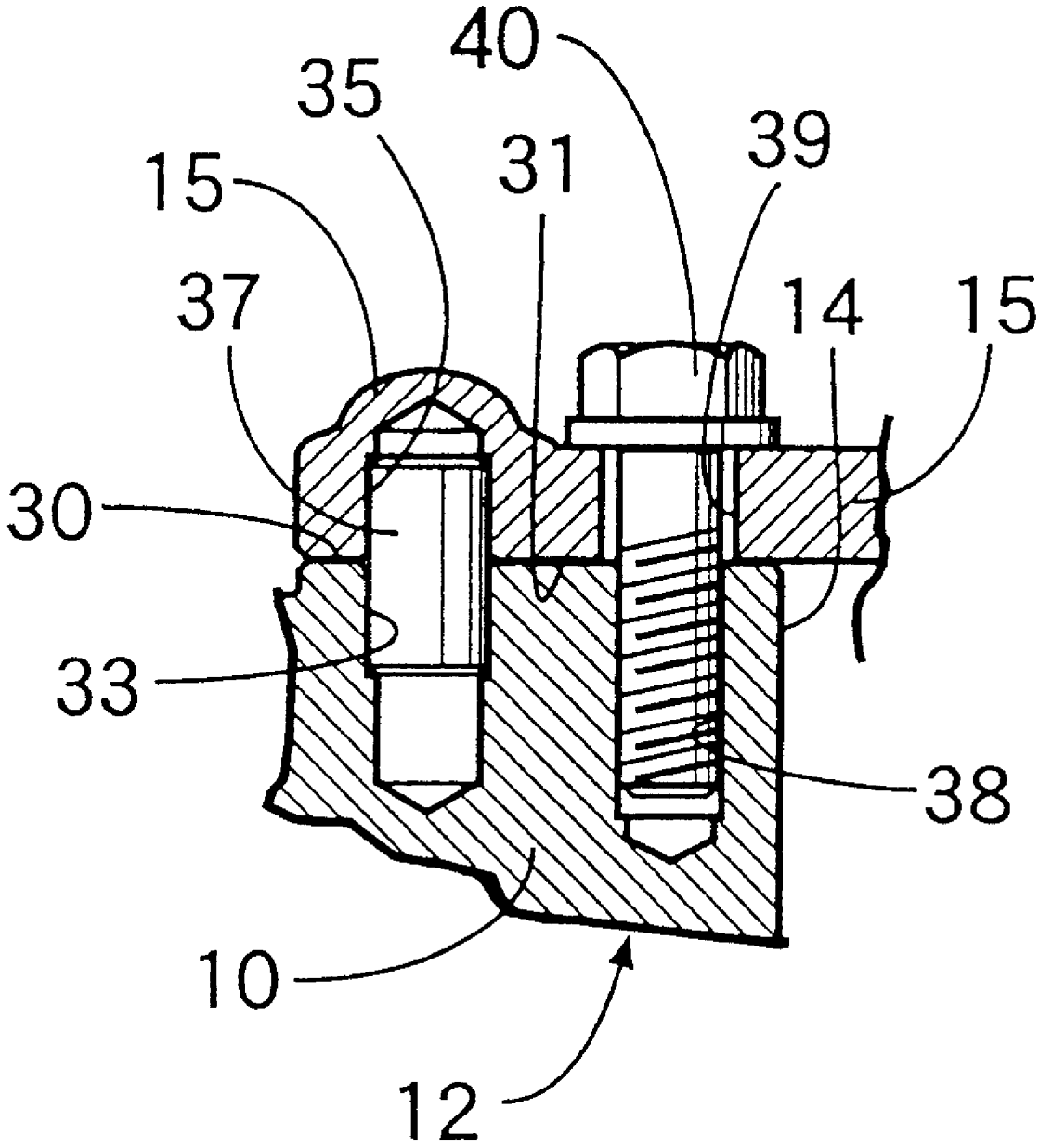
FIG. 6 is a cross-sectional view taken along section line 6—6 in FIG. 4.

A working bore 43*a* of the oil passage 43 opens into one side of the case cover 15, as shown in FIGS. 4 and 5. A hydraulic pressure sensor 46 is threadedly mounted in the working bore 43*a* to detect a pressure discharged from an oil pump 53 through the oil passage 43. With such a structure, it is not necessary to especially provide an exclusive bore for mounting the hydraulic pressure sensor 46 in the case cover 15, thereby leading to a reduction in cost. In this case, the disposition of the hydraulic pressure sensor 46, with a tip end turned laterally and rearwards of the outboard engine system O, decreases the overhanging of the hydraulic pressure sensor 46 in an outward direction of the engine block 12, which avoids increasing the size of the engine cover 4.

Referring again to FIG. 3, a valve operating camshaft 48 is disposed parallel relative to the crankshaft 5 and is carried in the cylinder head 16 coupled to a rear end of the cylinder block 11. Driving and driven pulleys 50 and 51 are secured to the crankshaft 5 and the camshaft 48 above the cylinder head 16 and the case cover 15, respectively, and a timing belt 52 is reeved around the driving and driven pulleys 50 and 51, so that the crankshaft 5 drives the camshaft 48 at a reduction ratio of ½.

The oil pump 53 is mounted at a lower rear portion of the cylinder block 11 and driven by the camshaft 48. The oil pump 53 pumps oil from an oil pan 54 (see FIG. 2) coupled to a lower portion of the engine block 12 and accommodated in the casing 3 to supply the oil to the oil passages 42 and 43 and other portions, thereby lubricating the first and second bearing bushes 22 and 23 and the like. The oil, which has finished the lubrication of the various portions, is passed through the lower portion of the crankcase 10 back to the oil pan 54.

As shown in FIGS. 2 to 4, a large number of mounting bosses are projectingly provided on an outer surface of the case cover 15. A recoiled starting device 58 is bolted to mounting bosses 55*a* to 55*c* disposed at apexes of a triangle at locations farthest from the crankshaft 5. In the present embodiment, a measure is taken so that the parts or components can be used commonly in any outboard engine system having a specification of 6 volts or 12 volts in power-generating and charging systems. For example, in the specification of 12 volts, a circular annular multi-pole power generating coil C (see FIG. 2) is secured by a bolt 59 to bosses 56*a* to 56*c* disposed at apexes of a triangle at locations closest to the crankshaft 5. In the specification of 6 volts, a semicircular igniting power coil is bolted at its opposite ends to bosses 57*a* and 57*b* disposed at intermediate locations, and semicircular charging coil is bolted at its opposite ends to bosses 57*c* and 57*d*.

Referring to FIG. 4, reference character U designates an igniting CDI device mounted on the side lid 10*b* and a boss formed on the case cover 15. Reference character S is a starting motor, and R is a regulator rectifier for a power supply, both of which are mounted on an upper wall of the engine block 12.

The operation of the engine E will be described below.

The bearing bore 20 for mounting of the first bearing bush 22 to support the first journal 25 of the crankshaft 5 is provided in the engine block 12, and the bearing bore 21 for mounting of the second bearing bush 23 to support the second journal 26 of the crankshaft 5 is provided in the case cover 15. Therefore, it is not necessary to machine the two members while in a coupled state in order to form the bearing bores 20 and 21 as is common in conventional engines. Thus, a step of coupling the two members to each other and a step of separating them from each other is not required, which reduces the manufacturing cost, but also permits replacement of either the engine block 12 and the case cover 15, leading to an enhanced interchangeability of parts.

Moreover, the supplying of a lubricating oil to the second journal 26 of the crankshaft 5 is conducted from the oil pump 53 through the oil passages 42 and 43 provided in the engine block 12 and the case cover 15. Therefore, it is not necessary to define an oil passage for lubricating the second journal 26 in the crankshaft 5, which also simplifies the structure or the oil passage in the crankshaft 5.

In addition, the halves of the knock pins 36 and 37 are fit on the positioning bores 32, 33, 34 and 35 which open into the joint faces 30 and 31 of the crankcase 10 having the first bearing bush 22 and the case cover 15 having the second bearing bush 23. Also, the crankcase 10 and the case cover 15 are coupled to each other by the plurality of bolts 40. Therefore, in a state in which the first and second bearing bushes 22 and 23 have been positioned accurately on the same axis, the crankcase 10 and the case cover 15 can be firmly coupled to each other, and the first and second journals 25 and 26 of the crankshaft 5 can be properly supported by the first and second bearing bushes 22 and 23.

Accordingly, when an explosion load is applied from the pistons 27, 27 to the crankshaft 5 through the connecting rods 28, 28 during an explosion stroke of the engine E, a shearing load is applied to the joint faces 30 and 31 of the crankcase 10 and the case cover 15. However, a shearing stress generated on the knock pins 36 and 37 and a frictional force applied to the joint faces 30 and 31 by the plurality of bolts 40 resists the shearing load.

Furthermore, because the pair of knock pins 36 and 37 are positioned closer to the cylinder block 11 than the second bearing bushes 23, when the explosion load is applied from the crankshaft 5 to the case cover 15, a tensile stress is generated in a wide area between the second bearing bushes 23 and the pair of knock pins 36 and 37. Therefore, because the case cover 15 is strongly resistant to the tensile stress, the case cover 15 exhibits a high rigidity in cooperation with the dispersion of the tensile stress.

In this way, the pair of knock pins 36 and 37 define the position for coupling of the crankcase 10 and the case cover 15 to each other, but also contribute to increasing the rigidity of the case cover 15. Therefore, it is possible to increase the supporting strength of the crankshaft 5, reduce the weight of the case cover 15, and decrease the number of bolts 40 used.

In addition, the knock pins 36 and 37 are positioned equidistantly on opposite sides of the plane P including the axis of the crankshaft 5 and the axes X of the cylinder bores 13, 13. Therefore, it is possible to effectively provide the equalization of the shearing load applied to both of the knock pins 36 and 37 and disperse the tensile stress generated on the case cover 15, thereby enhancing the durability of the knock pins 36 and 37 and the case cover 15.

Further, one knock pin 36 has a function of permitting communication between the oil passage 42 in the cylinder block 11 and the oil passage 43 in the case cover 15. Hence, the oil passage 42 and the knock pin 36 can be disposed coaxially, and as a result, the disposition of the oil passage 42 and the knock pin 36 in the narrow joint faces 30 and 31 can be easily achieved.

Yet further, the knock pins 36 and 37 are press-fit in the positioning bores 33, 33 in the crankcase 10, and hence, a fitting gap for the knock pins 36 and 37 may be provided only between the knock pins 36 and 37 and the positioning bores 34 and 35 in the case cover 15. Therefore, dislocation between the joint faces 30 and 31 of the crankcase 10 and the case cover 15 due to the fitting gap for the knock pins 36 and 37 can be minimized, wherein the accuracy of coupling the crankcase 10 and the case cover 15 is increased.

Although the preferred embodiment of the present invention has been described above in detail, it will be understood that the present invention is not limited to the above-described embodiment, and various modifications may be made without departing from the spirit and scope of the invention defined in claims. For example, three or more knock pins may be disposed at locations closer to the cylinder block than the second bearing bushes 23. In addition, the knock pins 36 and 37 may be press-fit into the positioning bores 34 and 35 in the case cover 15.

What is claimed is:

1. An engine comprising:

a crankshaft having first and second journals disposed at opposite ends of said crankshaft;

an engine block including a crankcase having a first bearing to support said first journal on one sidewall and an opening in the other sidewall to assemble said crankshaft;

a case cover coupled to said crankcase by a plurality of bolts to close the opening and having a second bearing to support said second journal; and at least two knock pins fit into said crankcase and said case cover over joint faces positioned closer to a cylinder bore in said engine block than said second bearing.

2. The engine according to claim 1, wherein said two knock pins are substantially equidistantly positioned on opposite sides of a plane including an axis of the cylinder bore and an axis of the crankshaft.

3. The engine according to either one of claim 1 or claim 2, wherein one of said knock pins has a hole, and an oil passage in said engine block and an oil passage in said case cover communicate with each other through said hole.

4. The engine according to claim 1, wherein said knock pins are press-fit into one of said crankcase and said case cover.

5. The engine according to claim 2, wherein said knock pins are press-fit into one of said crankcase and said case cover.

6. The engine according to claim 3, wherein said knock pins are press-fit into one of said crankcase and said case cover.

* * * * *